US010945522B2

(12) United States Patent
Huo

(10) Patent No.: US 10,945,522 B2
(45) Date of Patent: Mar. 16, 2021

(54) COMBINED MULTI-STYLE LEISURE FURNITURE

(71) Applicant: Foshan Lianrun Furniture Co., Foshan (CN)

(72) Inventor: Runzhong Huo, Foshan (CN)

( * ) Notice: Subject to any disclaimer, the term of this patent is extended or adjusted under 35 U.S.C. 154(b) by 0 days.

(21) Appl. No.: 16/659,760

(22) Filed: Oct. 22, 2019

(65) Prior Publication Data

US 2020/0305599 A1 Oct. 1, 2020

(51) Int. Cl.
*A47B 39/00* (2006.01)
*A47B 83/02* (2006.01)
*A47C 17/86* (2006.01)

(52) U.S. Cl.
CPC ..... *A47B 83/02* (2013.01); *A47C 17/86* (2013.01)

(58) Field of Classification Search
CPC ..... A47C 1/024; A47C 1/022; A47C 1/023; A47C 20/027; A47C 17/14; A47C 17/00; A47C 17/04; A47C 7/42; A47C 7/425; A47B 13/021; A47B 83/00
USPC ... 297/136, 135, 443, 411.23, 440.1, 440.16, 297/411.28, 230.1, 115, 227, 232, 233; 5/2.1
See application file for complete search history.

(56) References Cited

U.S. PATENT DOCUMENTS 2,466,204 A * 4/1949 Brown ..... 297/115
5,137,332 A * 8/1992 Gualtierotti ..... A47C 1/023 297/440.15
5,579,702 A * 12/1996 Aho ..... A47B 87/008 108/91
5,601,340 A * 2/1997 Stout ..... A47C 4/02 297/440.1
6,241,317 B1 * 6/2001 Wu ..... A47C 4/02 297/440.1
8,356,954 B2 * 1/2013 Koch ..... A47C 17/02 403/353
8,764,114 B1 * 7/2014 Frank ..... A47C 13/005 297/440.16
9,370,241 B1 * 6/2016 Dilmaghani ..... A47B 13/08
2012/0256464 A1 * 10/2012 Chang ..... A47C 13/005 297/440.16
2014/0312661 A1 * 10/2014 Behar ..... A47B 83/021 297/135
2016/0255956 A1 * 9/2016 Dilmaghani ..... A47B 87/0246
2017/0071354 A1 * 3/2017 Mezzera ..... A47C 13/005

* cited by examiner

*Primary Examiner* — Chi Q Nguyen

(57) ABSTRACT

Combined multi-style leisure furniture systems comprising one or more main body units and one or more auxiliary units on the main body units, wherein the main body unit is a main body of the furniture, and a plurality of mounting holes are distributed on the main body unit; the auxiliary unit is an auxiliary functional member on the main unit and is provided with an insertion fixing piece; the auxiliary unit is fixed to the main body unit by inserting the insertion fixing piece to the mounting hole of the main unit so as to form the combined multi-style leisure furniture. The invention is not only convenient to combine, but also has various combined styles, and it is little influenced by site limitation during application, and is suitable for various places such as homes, parks, lounges of public places, such as airports and railway stations and the like.

14 Claims, 3 Drawing Sheets

COMBINED MULTI-STYLE LEISURE FURNITURE

CROSS REFERENCE TO RELATED APPLICATIONS

This application claims priority to copending China Patent Application, No. 201910253696.1, filed on Mar. 30, 2019, which is hereby incorporated by reference for all purposes.

TECHNICAL FIELD

The invention relates to furniture, in particular to combined multi-style leisure furniture systems.

BACKGROUND ART

Conventional combined furniture mainly combines various functional furniture pieces placed at different positions, such as a plurality of groups of sofas and tea tables. The combination mode is that the sofas and the tea tables are placed at proper positions to be used by adjusting the positions between the sofas and the tea tables according to the use environment, but the overall combined structure is not changed greatly, and the combination mode only depends on the adjustment of the placement positions. In general, there are only a few possible combinations, the application flexibility is not strong, and the influence of site limitation is great.

SUMMARY

It is an object of the present invention to provide a combined multi-style leisure furniture system in order to solve the above-mentioned problems of the conventional combined furniture.

The purpose of the invention can be achieved through the following technical scheme:

A combined multi-style leisure furniture system comprises one or more main body units and one or more auxiliary units on the main body units, wherein the main body unit is a main body of the furniture, and a plurality of mounting holes are distributed on the main body units; the auxiliary unit is an auxiliary functional member on the main body unit and is provided with an insertion fixing piece; the auxiliary unit is fixed to the main body unit by inserting the insertion fixing piece to the mounting hole of the main body unit so as to form the combined multi-style leisure furniture.

The purpose of the invention can also be achieved through the following technical scheme.

Further, the main body units are mutually matched and combined, and the auxiliary units are selectively inserted and installed according to the combined main body units, so that the main body units are combined into a whole.

Further, the main body units consist of a base and a seat body on the base, and the mounting hole is arranged in the base and/or the seat body.

Further, the mounting holes are distributed at edge positions, middle positions, or any positions of the base and/or the seat body.

Furthermore, the mounting holes of the base and the seat body correspond to each other, and the auxiliary unit is fixed by mounting the insertion fixing piece to the mounting holes of the base and/or the seat body.

Further, the auxiliary units comprise an armrest, a backrest, a chair and a tea table.

Further, the insertion fixing piece is a supporting rod arranged on the auxiliary unit.

Further, the base is a fixing frame, the seat body is a cushion, the mounting hole comprises a fixing hole in the fixing frame and a through hole in the cushion, and the auxiliary unit is fixed by mounting the insertion fixing piece passing through the through hole of the seat body to the fixing hole in the base.

Further, a plurality of sleeves are arranged on the base, a planar supporting plate is arranged outside of the upper end of the sleeve, and the mounting holes are through holes in the sleeves.

Further, a connecting rib is arranged between the planar supporting plates of the sleeves, and a plane for supporting the seat body are formed between the connecting ribs.

The invention has the following prominent substantive features and significant advances.

The invention comprises one or more main body units and one or more auxiliary units on the main body units, wherein the main body unit is a main body of the furniture, and a plurality of mounting holes are distributed on the main body units; the auxiliary unit is an auxiliary functional member on the main body unit and is provided with an insertion fixing piece; the auxiliary unit is fixed to the main body unit by inserting the insertion fixing piece to the mounting hole of the main body unit so as to form the combined multi-style leisure furniture. Therefore, the invention not only convenient to combine, but also has various combined styles, and it is little influenced by site limitation during application, and is suitable for various places such as homes, parks, lounges of public places, such as airports and railway stations and the like.

The plurality of main body units of the invention are mutually matched and combined, the auxiliary units are selectively inserted and installed according to the combined main body units, so that the main body units are combined into a whole, and therefore structures with different sizes can be combined according to specific use environments, the combination is flexible, and the application range is wide.

The base of the invention is a fixing frame, the seat body is a cushion, the mounting hole comprises a fixing hole in the fixing frame and a through hole in the cushion, and the auxiliary unit is fixed by mounting the insertion fixing piece passing through the through hole of the seat body to the fixing hole in the base. Therefore, the invention has simple installation and a compact structure.

A plurality of sleeves are arranged on the base of the invention, a planar supporting plate is arranged outside the upper end of the sleeve, and the mounting holes are through holes in the sleeves. The invention has simple manufacture and convenient installation, and can be configured to stably and fixedly install the auxiliary unit.

DETAILED DESCRIPTION

Figure 1:
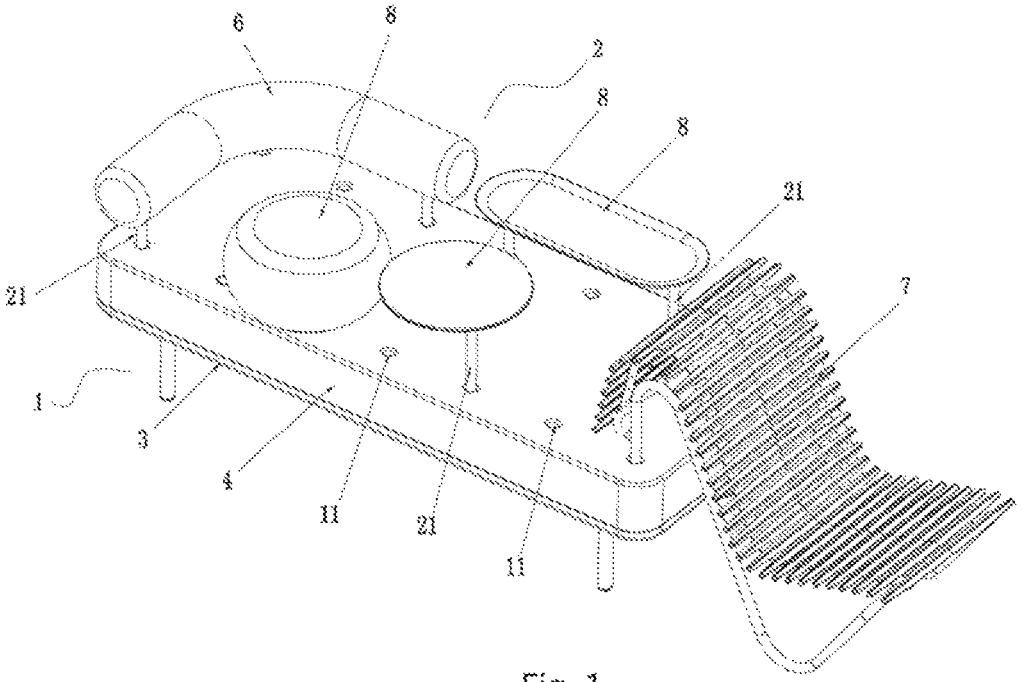
FIG. 1 is a structurally schematic view of an embodiment of the present invention.
Figure 2:
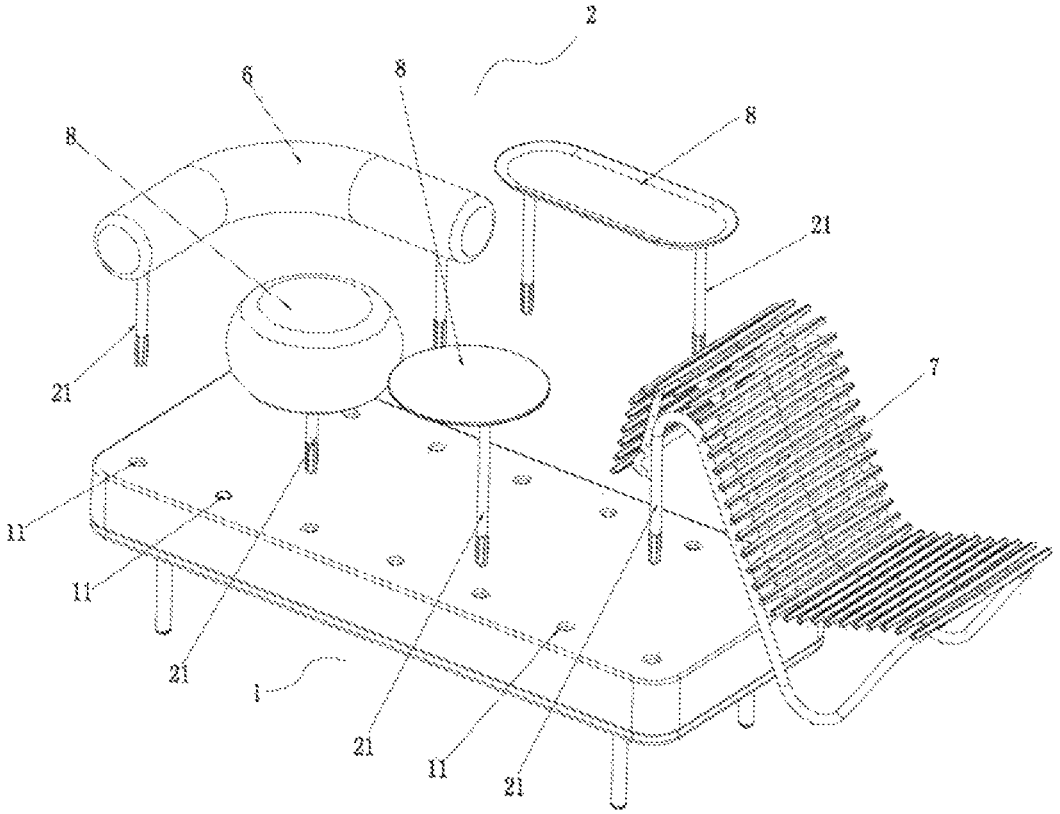
FIG. 2 is a schematic view showing the installation of a main body unit and an auxiliary unit according to an embodiment of the present invention.
Figure 3:
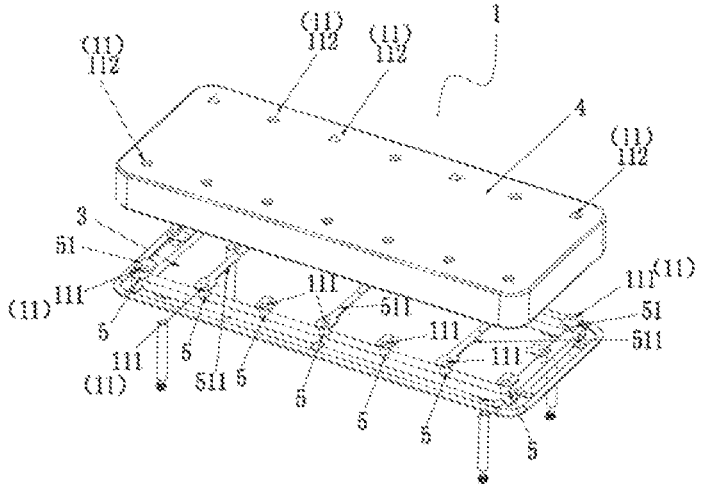
FIG. 3 is a schematic view showing the installation of a base and a seat body according to an embodiment of the present invention.
Figure 4:
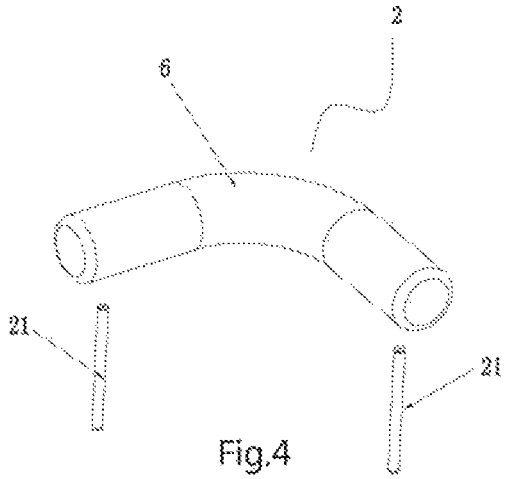
FIG. 4 is a schematic view showing the installation of an auxiliary unit in the form of a backrest according to an embodiment of the present invention.
Figure 5:
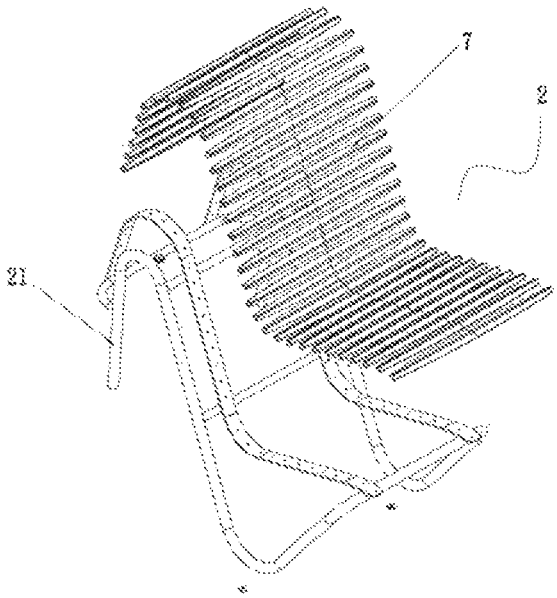
FIG. 5 is a schematic view showing the installation of an auxiliary unit in the form of a chair according to an embodiment of the present invention.
Figure 6:
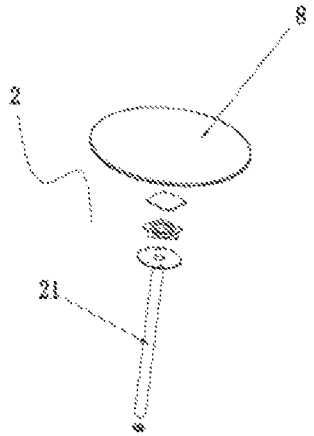
FIG. 6 is a schematic view showing the installation of an auxiliary unit in the form of a tea table according to an embodiment of the present invention.
Figure 7:
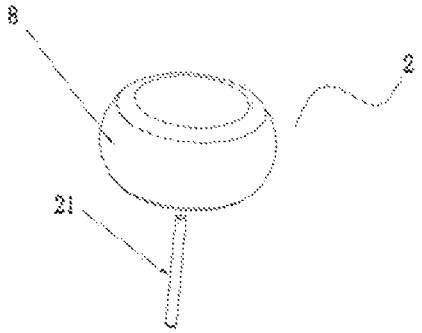
FIG. 7 is a schematic view showing the installation of an auxiliary unit in the form of a tea table according to an embodiment of the present invention.
Figure 8:
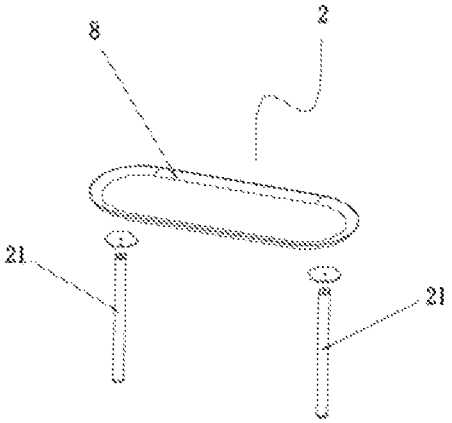
FIG. 8 is a schematic view showing the installation of the auxiliary unit in the form of a tea table according to an embodiment of the present invention.

The disclosed multi-style leisure furniture will become better understood through review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of various multi-style leisure furniture are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The present invention will now be described in further detail with reference to the accompanying drawings.

The combined multi-style leisure furniture comprises one or more main body units 1 and one or more auxiliary units 2 on the main body units 1, wherein the main body unit 1 is a main body of the furniture, and a plurality of mounting holes 11 are distributed on the main body units 1; the auxiliary unit 2 is an auxiliary) functional member on the main body unit 1 and is provided with an insertion fixing piece 21; the auxiliary unit 2 is fixed to the main body unit 1 by inserting the insertion fixing piece 21 to the mounting hole 11 of the main body unit 1 so as to form the combined multi-style leisure furniture.

In the embodiment, the main body units 1 are mutually matched and combined, the auxiliary units 2 are selectively inserted and installed according to the combined main body units 1, so that the main body units 1 are combined into a whole and are fixedly connected with each other, and by means of the matched and combined main body units, the main body units 1 and the auxiliary units 2 can be selectively combined to form leisure furniture with different sizes, shapes, structures and use performances.

The body units 1 consist of a base 3 and a seat body 4 on the base 3, which form a sofa-like structure and have a sofa function, the mounting holes 11 being arranged in the base 3 or/and the seat body 4. The auxiliary units 2 comprise an armrest, a backrest 6, a chair 7 and a tea table 8; the insertion fixing piece 21 is a supporting rod arranged on the auxiliary unit 2, that is, the insertion fixing piece 21 is a supporting rod arranged on the armrest, the backrest 6, the chair 7 and the tea table 8. The mounting holes 11 are distributed at edge positions, middle positions, or at any position of the base 3 or/and the seat body 4. When being applied, the armrest, the backrest 6, the chair 7 and the tea table 8 of the auxiliary units 2 can be optionally selected, and be combined, fixed and used by inserting the insertion fixing piece 21 to the corresponding mounting holes 11 of the base 3 or/and the seat body 4, that is, the auxiliary units 2 are fastened and fixed by inserting the supporting rods to the mounting holes 11 or by means of bolts, screws or screwing and the like, so as to be combined into various types of furniture.

Furthermore, the mounting holes 11 of the base 3 and the seat body 4 correspond to each other, and the auxiliary units 2 are fixed by mounting the insertion fixing pieces 2 to the mounting holes 11 of the base 3 or/and the seat body 4, namely, the armrest, the backrest 6, the chair 7 and the tea table 8 of the auxiliary units 2 are fixed by inserting the supporting rods to the mounting holes 11 of the base 3 or/and the seat body 4. Specifically, it further includes that the base 3 is a fixing frame, the seat body 4 is a cushion, the mounting hole 11 comprises a fixing hole 111 in the fixing frame and a through hole 112 in the cushion, and the auxiliary unit 2 is fixed by mounting the insertion fixing piece 2 passing through the through hole 112 of the seat body 4 to the fixing hole 111 in the base 3.

A plurality of sleeves 5 are arranged on the base 3, a planar supporting plate 51 is arranged outside the upper end of the sleeve 5, and the mounting holes 11 are through holes in the sleeves. A connecting rib 511 is arranged between the planar supporting plates 51 of the sleeves 5, the connecting rib 511 is of a sheet structure, and a plane for supporting the seat body 4 is formed between the connecting ribs 511. In application, the seat body 4 is placed flatly on the plane in which each of the connecting ribs 511 form the seat body 4.

While the above mentioned has been described only with reference to preferred embodiments thereof, it is not intended to the invention in any forms. It will be understood by those skilled in the art that variations, modifications, and the like can be made to the disclosed structures and techniques without departing from the scope of the invention. The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A combined multi-style leisure furniture system, comprising:

a plurality of auxiliary units;

at least one main body unit, wherein the main body unit is a main body of the furniture system, and wherein the main body unit includes a plurality of mounting holes distributed on the main body unit; and an auxiliary unit in the plurality of auxiliary units, wherein the auxiliary unit is an auxiliary functional member on the main body unit and is provided with an insertion fixing piece, wherein the auxiliary unit is fixed to the main body unit by inserting the insertion fixing piece to the mounting hole of the main body unit to define a combined main body unit, wherein the main body unit consists of a base and a seat body on the base, wherein at least a portion of the plurality of mounting holes are arranged in one or more of the base and the seat body, wherein the mounting holes of the base and the seat body correspond to each other, and wherein the auxiliary unit is fixed by mounting the insertion fixing piece to the mounting hole of one or more of the base and the seat body.

2. The combined multi-style leisure furniture system according to claim 1, wherein more than one of the main body units are mutually matched and combined, wherein the plurality of auxiliary units are selectively inserted and installed to define a combined main body, and wherein the more than one main body units are connected together to define a composite structure.

3. The combined multi-style leisure furniture system according to claim 1, wherein the mounting holes are also distributed at positions along an edge of the main body unit or positions proximate a middle of the main body unit.

4. The combined multi-style leisure furniture system according to claim 1, wherein the plurality of auxiliary units comprise an armrest, a backrest, a chair and a tea table.

5. The combined multi-style leisure furniture system according to claim 1, wherein the insertion fixing piece is a supporting rod arranged on the auxiliary unit.

6. A combined multi-style leisure furniture system, comprising:

a plurality of auxiliary units;

at least one main body unit, wherein the main body unit is a main body of the furniture system, and wherein the main body unit includes a plurality of mounting holes distributed on the main body unit; and an auxiliary unit in the plurality of auxiliary units, wherein the auxiliary unit is an auxiliary functional member on the main body unit and is provided with an insertion fixing piece, wherein the auxiliary unit is fixed to the main body unit by inserting the insertion fixing piece to the mounting hole of the main body unit to define a combined main body unit, wherein the main body unit consists of a base and a seat body on the base, wherein at least a portion of the plurality of mounting holes are arranged in one or more of the base and the seat body, wherein the mounting holes are also distributed at positions along an edge of the main body unit or positions proximate a middle of the main body unit, wherein the base is a fixing frame, the seat body is a cushion, and the plurality of mounting holes comprise a fixing hole in the fixing frame and a through hole in the cushion, and wherein the auxiliary unit is fixed by mounting the insertion fixing piece passing through the through hole of the seat body to the fixing hole in the base.

7. The combined multi-style leisure furniture system according to claim 6, wherein more than one of the main body units are mutually matched and combined, wherein the plurality of auxiliary units are selectively inserted and installed to define a combined main body, and wherein the more than one main body units are connected together to define a composite structure.

8. The combined multi-style leisure furniture system according to claim 6, wherein the plurality of auxiliary units comprise an armrest, a backrest, a chair and a tea table.

9. The combined multi-style leisure furniture system according to claim 6, wherein the insertion fixing piece is a supporting rod arranged on the auxiliary unit.

10. A combined multi-style leisure furniture system, comprising:

a plurality of auxiliary units;

at least one main body unit, wherein the main body unit is a main body of the furniture system, and wherein the main body unit includes a plurality of mounting holes distributed on the main body unit; and an auxiliary unit in the plurality of auxiliary units, wherein the auxiliary unit is an auxiliary functional member on the main body unit and is provided with an insertion fixing piece, wherein the auxiliary unit is fixed to the main body unit by inserting the insertion fixing piece to the mounting hole of the main body unit to define a combined main body unit, wherein the main body unit consists of a base and a seat body on the base, wherein at least a portion of the plurality of mounting holes are arranged in one or more of the base and the seat body, wherein the mounting holes are also distributed at positions along an edge of the main body unit or positions proximate a middle of the main body unit;

a plurality of sleeves arranged on the base; and a planar supporting plate arranged outside an upper end of the sleeve, wherein the plurality of mounting holes are through holes in the sleeves.

11. The combined multi-style leisure furniture system according to claim 10, wherein:

a connecting rib is arranged between a plurality of planar supporting plates of the sleeves; and a plane for supporting the seat body is formed between the connecting ribs.

12. The combined multi-style leisure furniture system according to claim 10, wherein more than one of the main body units are mutually matched and combined, wherein the plurality of auxiliary units are selectively inserted and installed to define a combined main body, and wherein the more than one main body units are connected together to define a composite structure.

13. The combined multi-style leisure furniture system according to claim 10, wherein the plurality of auxiliary units comprise an armrest, a backrest, a chair and a tea table.

14. The combined multi-style leisure furniture system according to claim 10, wherein the insertion fixing piece is a supporting rod arranged on the auxiliary unit.

* * * * *